US010240826B2

(12) United States Patent
Diem et al.

(10) Patent No.: US 10,240,826 B2
(45) Date of Patent: Mar. 26, 2019

(54) HEAT EXCHANGER

(71) Applicant: MAHLE International GmbH, Stuttgart (DE)

(72) Inventors: Johannes Diem, Weissach (DE); Uwe Foerster, Erdmannhausen (DE); Pedro Gonzalez Rechea, Stuttgart (DE); Klaus Haβdenteufel, Gerlingen (DE); Herbert Hofmann, Stuttgart (DE); Martin Kaspar, Fellbach (DE)

(73) Assignee: MAHLE International GmbH, Stuttgart (DE)

( * ) Notice: Subject to any disclaimer, the term of this patent is extended or adjusted under 35 U.S.C. 154(b) by 263 days.

(21) Appl. No.: 14/309,422

(22) Filed: Jun. 19, 2014

(65) Prior Publication Data

US 2014/0298853 A1 Oct. 9, 2014

Related U.S. Application Data

(63) Continuation of application No. PCT/EP2012/076045, filed on Dec. 18, 2012.

(30) Foreign Application Priority Data

Dec. 19, 2011 (DE) ..... 10 2011 089 091

(51) Int. Cl.
*F28F 9/02* (2006.01)
*F28D 1/06* (2006.01)
(Continued)

(52) U.S. Cl.
CPC ..... *F25B 39/04* (2013.01); *F28D 1/0443* (2013.01); *F28F 9/0209* (2013.01);
(Continued)

(58) Field of Classification Search
CPC ..... F28F 9/0212; F28F 1/022; F28D 1/05383; F28D 1/05366; F28D 1/05358;
(Continued)

(56) References Cited

U.S. PATENT DOCUMENTS 5,956,846 A * 9/1999 Ross ..... F28D 1/0391 165/153
6,539,746 B1 * 4/2003 Haussmann ..... B60H 1/3204 62/503
(Continued)

FOREIGN PATENT DOCUMENTS

EP 0 995 962 B1 8/2002
EP 1 464 906 A2 10/2004
(Continued)

*Primary Examiner* — Jason N Thompson
(74) *Attorney, Agent, or Firm* — Muncy, Geissler, Olds & Lowe, P.C.

(57) ABSTRACT

A heat exchanger is provided that includes a first tube/fin block, first headers arranged on both sides of the first tube/fin block, which first headers communicate with the tubes of the first tube/fin block, and a second tube/fin block having second headers arranged on both sides of the second tube/fin block, which second headers communicate with the tubes of the second tube/fin block, wherein the first tube/fin block having the corresponding first headers is an air-cooled low-temperature coolant cooler and the second tube/fin block having the corresponding second headers is an air-cooled refrigerant cooler, wherein the headers of the first tube/fin block arranged on a respective side of the tube-fin block and a header of the second tube/fin block are connected to one another.

13 Claims, 9 Drawing Sheets

(51) Int. Cl.

| | |
|---|---|
| ***F25B 7/00*** | (2006.01) |
| ***F25B 39/04*** | (2006.01) |
| ***F28D 1/04*** | (2006.01) |
| *F25B 40/02* | (2006.01) |

(52) U.S. Cl.
CPC ..... *F28F 9/0251* (2013.01); *F25B 40/02* (2013.01); *F25B 2339/044* (2013.01)

(58) Field of Classification Search
CPC ..... F28D 1/05341; F28D 1/05333; F28D 1/05308; F28D 1/0426; F28D 1/0417; F28D 1/0443; F28D 1/0408; F25B 39/04; F25B 40/02
USPC ..... 165/132
See application file for complete search history.

(56) References Cited

U.S. PATENT DOCUMENTS 6,564,863 B1 * 5/2003 Martins ..... F28D 1/05383 165/153
7,048,044 B2 * 5/2006 Ban ..... B60H 1/00314 165/202
7,284,594 B2 * 10/2007 Sanada ..... F28F 9/002 165/132
7,520,320 B2 * 4/2009 Itoh ..... B60H 1/00385 165/202
8,051,809 B2 11/2011 Guerrero et al.
2003/0213587 A1 * 11/2003 Mano ..... B60K 6/40 165/174
2004/0200610 A1 * 10/2004 Hara ..... B60H 1/00314 165/202
2004/0251013 A1 * 12/2004 Kawakubo ..... F28F 1/022 165/172
2005/0217839 A1 * 10/2005 Papapanu ..... F28D 1/0443 165/185
2005/0274507 A1 12/2005 Sanada et al.
2007/0056718 A1 3/2007 Yamamoto et al.
2007/0137839 A1 * 6/2007 Yamamoto ..... F28D 1/0443 165/140
2008/0047687 A1 * 2/2008 Leitch ..... F28D 1/0443 165/70
2008/0115528 A1 * 5/2008 Yamamoto ..... B60H 1/3227 62/513
2009/0154091 A1 * 6/2009 Yatskov ..... F28D 1/0426 361/679.49
2010/0147006 A1 * 6/2010 Taras ..... F25B 7/00 62/335

FOREIGN PATENT DOCUMENTS

| | | | |
|---|---|---|---|
| EP | 2 051 037 | A1 | 4/2009 |
| EP | 2 317 265 | A2 | 5/2011 |
| EP | 2 730 439 | A1 | 5/2014 |
| JP | 2001-174168 | A | 6/2001 |
| JP | 2005 343221 | A | 12/2005 |
| WO | WO 2004/085810 | A2 | 10/2004 |
| WO | 2008/072730 | A1 | 6/2008 |

* cited by examiner

HEAT EXCHANGER

This nonprovisional application is a continuation of International Application No. PCT/EP2012/076045, which was filed on Dec. 18, 2012, and which claims priority to German Patent Application No. 10 2011 089 091.2, which was filed in Germany on Dec. 19, 2011, and which are both herein incorporated by reference.

BACKGROUND OF THE INVENTION

Field of the Invention

The invention relates to a heat exchanger and to an arrangement of heat exchangers.

Description of the Background Art

Vehicle refrigerant circuits, in which a condenser is employed in order to cool and condense the refrigerant, which is brought to a high pressure by a compressor, are used in climate control systems in motor vehicles. The thus condensed refrigerant is then evaporated in an evaporator, which is connected downstream of the condenser, so that because of a heat exchange between air, flowing through the evaporator, and the refrigerant, the air is cooled in order to be able to control the temperature of or cool the motor vehicle interior.

To increase the evaporator capacity, the refrigerant is therefore cooled more greatly in the condenser than is necessary for mere condensation. As a result, the inlet enthalpy in the evaporator is reduced further. When coolant-cooled condensers, which are also called indirect condensers, are used, the waste heat of the condenser is given off not directly to the air, but to a coolant, connected there between, in a coolant circuit, whereby as a result the lowest temperature of the coolant in the coolant circuit is much higher than in air-cooled condensers, because the employed coolant in the coolant circuit has a much higher coolant temperature than the ambient air that cools the refrigerant in air-cooled condensers. This means that in these so-called indirect condensers the inlet enthalpy at the evaporator has not declined so far that performance losses in the evaporator result.

The air-cooled condenser does not have these problems, but it requires a relatively large amount of installation space in the front area of the vehicle, which in modern motor vehicles is not always available or cannot always be made available to the necessary extent.

The air-cooled condensers are also beset with the problem that they are often damaged in accidents with front damage to the vehicle and the refrigerant can then escape, whereby in the case of modern chemical refrigerants this can result in considerable costs. Efforts are therefore made to remove the air-cooled condenser from the front area of the motor vehicle in order to protect it in an accident situation. However, this cannot be done with air-cooled technology, because, for example, sufficient air for cooling the refrigerant is not available in another position in the engine compartment. Therefore, it is advantageous that the condenser is operated with coolant cooling.

WO 2004/085810, which corresponds to U.S. Pat. No. 8,051,809, proposes as a solution to this problem the provision of a subcooler, which is operated with a coolant of a low-temperature cooler. This has the disadvantage, however, of a very high interconnection complexity for providing the low-temperature coolant and often results in a rather poor controllability of the entire system.

SUMMARY OF THE INVENTION

It is therefore an object of the present invention to provide a heat exchanger, which solves the aforementioned problem and yet provides a condenser subcooler that subcools the refrigerant downstream of the condenser so far that it has an acceptable inlet enthalpy at the evaporator. It is a further object of the invention to provide an arrangement of heat exchangers that solves the aforementioned problem.

In an embodiment it is advantageous, in conjunction with a coolant-cooled condenser, to use a heat exchanger, with a first tube/fin block and first headers, arranged on both sides of the first tube/fin block and communicating with the tubes of the first tube/fin block, and a second tube/fin block having two headers arranged on both sides of the second tube/fin block and communicating with the tubes of the second tube/fin block, whereby the first tube/fin block with the corresponding first headers is an air-side cooled low-temperature coolant cooler and the second tube/fin block with the corresponding second headers is an air-side cooled refrigerant cooler, whereby the headers, arranged on a respective side of the tube/fin block, of the first tube/fin block and the headers of the second tube/fin block are connected to one another.

The thus designed low-temperature coolant cooler can be used to cool the refrigerant from the coolant-cooled condenser, whereby an air-side cooled refrigerant cooler, connected downstream of it, is used as a subcooler to cool the refrigerant coming from the condenser, cooled with the low-temperature coolant, to a lower temperature.

The headers, connected to one another, of the first or second tube/fin block can be configured integrally with one another. Here "integrally" can mean that the headers are configured connected to one another, whereby in the case of a one-part header for the first and for the second tube/fin block the connected common header can also be configured integrally. If two-part headers with a header base and a header cover are used, the common headers are also configured two-part insofar as they also have a tube bottom and a tube cover.

The first header of the first tube/fin block and the first header of the second tube/fin block can be configured integrally and the second header of the first tube/fin block and the second header of the second tube/fin block can be configured integrally. The statements made above apply similarly with respect to the design of two-part headers.

In a further exemplary embodiment of the present invention, the first and/or the second header of the first tube/fin block can be provided with a first and/or a second fluid connection, and the first and/or the second header of the second tube/fin block can be provided with a third and/or fourth fluid connection. In this regard, it can be advantageous depending on the interconnection, if in a first exemplary embodiment both headers are provided with an inlet or outlet as the fluid connection or in the case of a redirection the inlet and outlet of a tube/fin block can also be arranged at a header.

A refrigerant collector can be connected upstream of the tube/fin block of the refrigerant cooler in the fluid flow. It is also expedient if a collector is interposed relative to the tube/fin block of the refrigerant cooler. This means that the tube/fin block is divided and a collector is inserted in the fluid flow in the course of the particular fluid channel.

In this case, the refrigerant collector can be configured as a straightforward collector, but it can also contain a filter and/or a dryer in order to filter and/or dry the refrigerant flowing through the refrigerant collector.

The collector can be connected fluidically via a fluid connection with a header of the refrigerant cooler to the tube/fin block of the refrigerant cooler. Also, the collector can be connected to the header via a flange or via a connecting tube. It is advantageous in this case to form the fluid connection as a flange or a connecting tube.

The object for the arrangement of heat exchangers is attained further with an arrangement with a coolant-cooled condenser for deheating and condensing refrigerants, particularly in a refrigerant circuit of motor vehicles, furthermore with an air-cooled refrigerant subcooler, in which the refrigerant, previously cooled and condensed in the condenser, is cooled further.

The coolant-cooled condenser can be cooled by a low-temperature coolant from a low-temperature coolant circuit.

A collector can be arranged in the fluid flow between the coolant-cooled condenser and the air-cooled subcooler.

The air-cooled subcooler can be configured as a structural unit with an air-cooled low-temperature cooler of the low-temperature circuit.

The air-cooled subcooler can be configured separated from an air-cooled low-temperature cooler of the low-temperature circuit, but is connected in particular to it as a module.

A header of the first tube/fin block and a header of the second tube/fin block can be configured as a one-row tube.

A header of the first tube/fin block and a header of the second tube/fin block can be configured as a two-row tube, whereby in each case a tube of the two-row tubes forms the respective header.

At least one tube of the first tube/fin block and at least one tube of the second tube/fin block can each be configured as a one-row tube.

At least one tube of the first tube/fin block and at least one tube of the second tube/fin block can be configured as a two-row tube, whereby in each case a tube of the two-row tube forms the respective tube.

A tube and/or a header of the first tube/fin block can be the same as or different from a tube and/or a header of the second tube/fin block.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
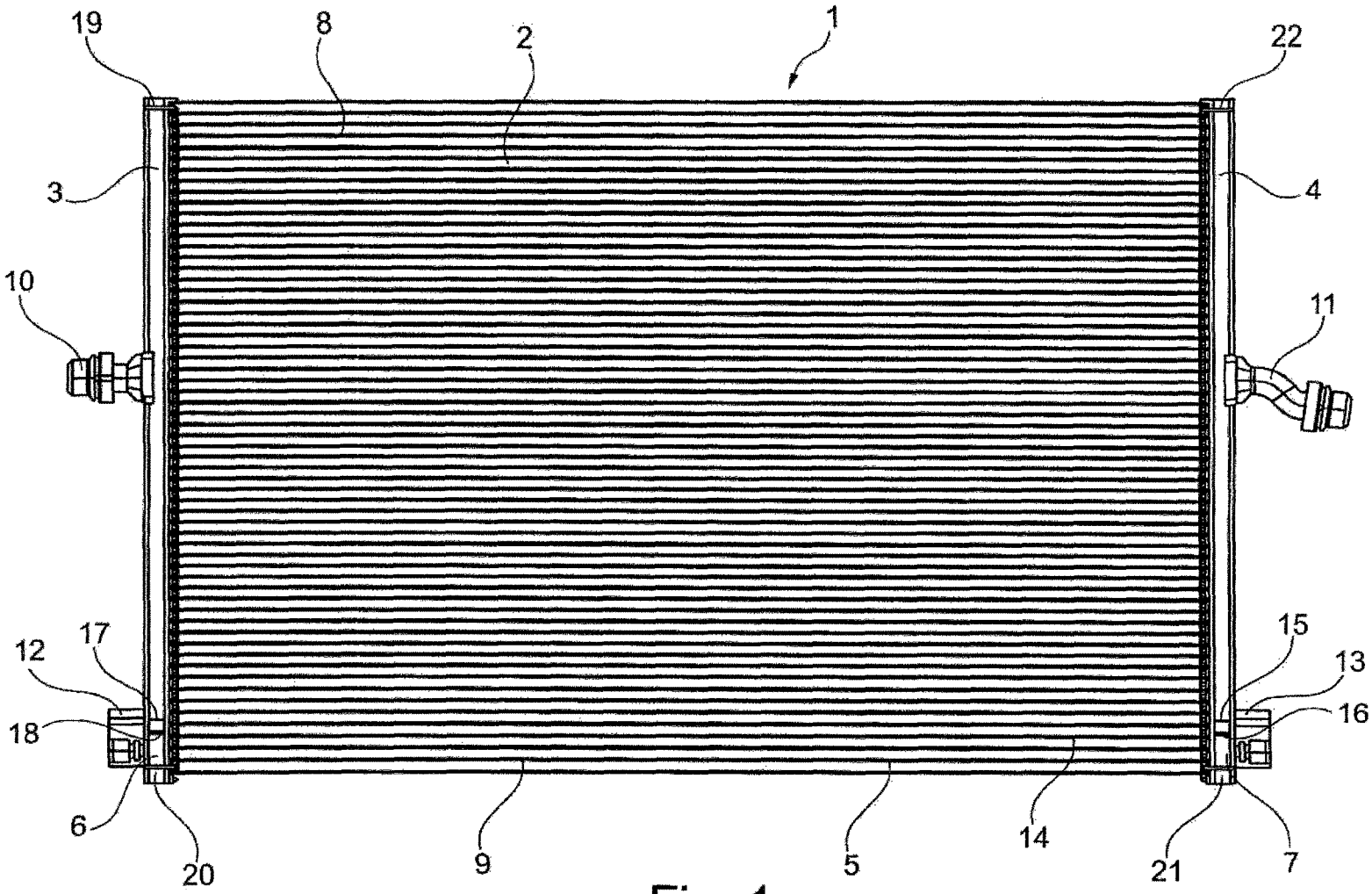
FIG. 1 illustrates an exemplary embodiment of a heat exchanger of the invention.

FIG. 1 shows a heat exchanger 1 with a first tube/fin block 2 and first headers 3, 4 arranged on both sides of first tube/fin block 2. Furthermore, heat exchanger 1 has a second tube/fin block 5, in which second headers 6, 7 are arranged again on both sides of tube/fin block 5. Tubes 8 of first tube/fin block 2 communicate on both sides with a header 3, 4, whereby the ends of tubes 8 are inserted in the openings of the headers and are arranged there fluid-connected. Tubes 9 of the second tube/fin block communicate with header 6, 7 of second tube/fin block 5, whereby again this tube 9 is inserted on both sides with its end regions into the openings of headers 6, 7, sealed, and connected fluidically.

In this case, the first heat exchanger region with first tube/fin block 2 and headers 3, 4 is configured according to the invention as a low-temperature coolant cooler and the second heat exchanger region with tube/fin block 5 and headers 6, 7 is configured as a refrigerant cooler, such as particularly a refrigerant subcooler.

It is especially preferred, if headers 3 and 6, and headers 4 and 7 are each configured integrally with one another. In the exemplary embodiment of FIG. 1, the headers are configured as headers with a base/cover configuration, so that they are basically formed as two-part headers. In the case that headers 3, 6 of the invention are configured as one-part headers, this means that these headers each have a one-part cover or a one-part base, which extends over the entire length of the header of the first and second tube/fin block.

Heat exchanger 1 has a first fluid connection 10 for admitting a fluid into the low-temperature coolant cooler and a fluid connection 11, which serves as an outlet for the low-temperature coolant cooler. The two fluid connections 10, 11 are configured as tube connections, which are connected to respective header 3, 4.

Alternatively, a fluid connection can be arranged as a fluid inlet on a header and a second fluid connection as an outlet on the same header, whereby then typically a partition wall is provided between these connected regions to divide the inlet-side area of the header from the outlet-side area of the header. The opposite header, which would be opposite to the tube/fin block, would advantageously have no fluid connection. It is then used only for redirecting the fluid flow from the one group of tubes to another group of tubes.

Header 6 and header 7 furthermore also have a fluid connection 12, 13, whereby fluid connection 12 is connected as an inlet fluid connection to header 6 and fluid connection 13 as an outlet-side fluid connection to header 7. Fluid connections 12, 13 are advantageously configured as connecting flanges and are used for connecting a connecting tube to the header.

It may be expedient in the case of the refrigerant cooler or refrigerant subcooler, if both the fluid connection for the inlet and the fluid connection for the outlet are connected to a header, whereby here as well a partition wall is provided between the areas within the header, which are connected to the respective fluid connections. The header opposite to the tube/fin block would then again have the function of redirecting the refrigerant or fluid from the one group of tubes to another group of tubes. Preferably no fluid connection would be provided there.

As is evident, the entire tube/fin block 2, 5 has a number of tubes 8 or a number of tubes 9, which are associated with tube/fin block 2 of the low-temperature coolant cooler or tube/fin block 5 of the refrigerant cooler. Thus, it can be seen in FIG. 1 that a plurality of tubes 8 are associated with tube/fin block 2 of the low-temperature coolant cooler and only a small number of tubes 9 with tube/fin block 5 of the refrigerant cooler or refrigerant subcooler.

It is evident further that between tube/fin block 2 of the low-temperature coolant cooler and tube/fin block 5 of the refrigerant cooler a tube or a bar or a spacer 14 is arranged, which separates tube/fin block 2 of the low-temperature coolant cooler from tube/fin block 5 of the refrigerant cooler. This element 14 can be configured as a tube or as a metal strip, which is inserted in the tube/fin block as if it were a tube. Tube 14 or strip 14, however, is not integrated into the refrigerant circuit or the low-temperature coolant circuit. To this end, on both sides of the tubes in the area of headers 4, 7 or 3, 6 partition walls 15, 16, 17, 18 are arranged, which separate the area in which the tube or strip 14 penetrates into a passage or an opening of the header.

Furthermore, headers 3, 6, 4, 7 have metal panels 19, 20, 21, 22, which are used to close headers 3, 6, 4, 7 on one side.

Figure 2:
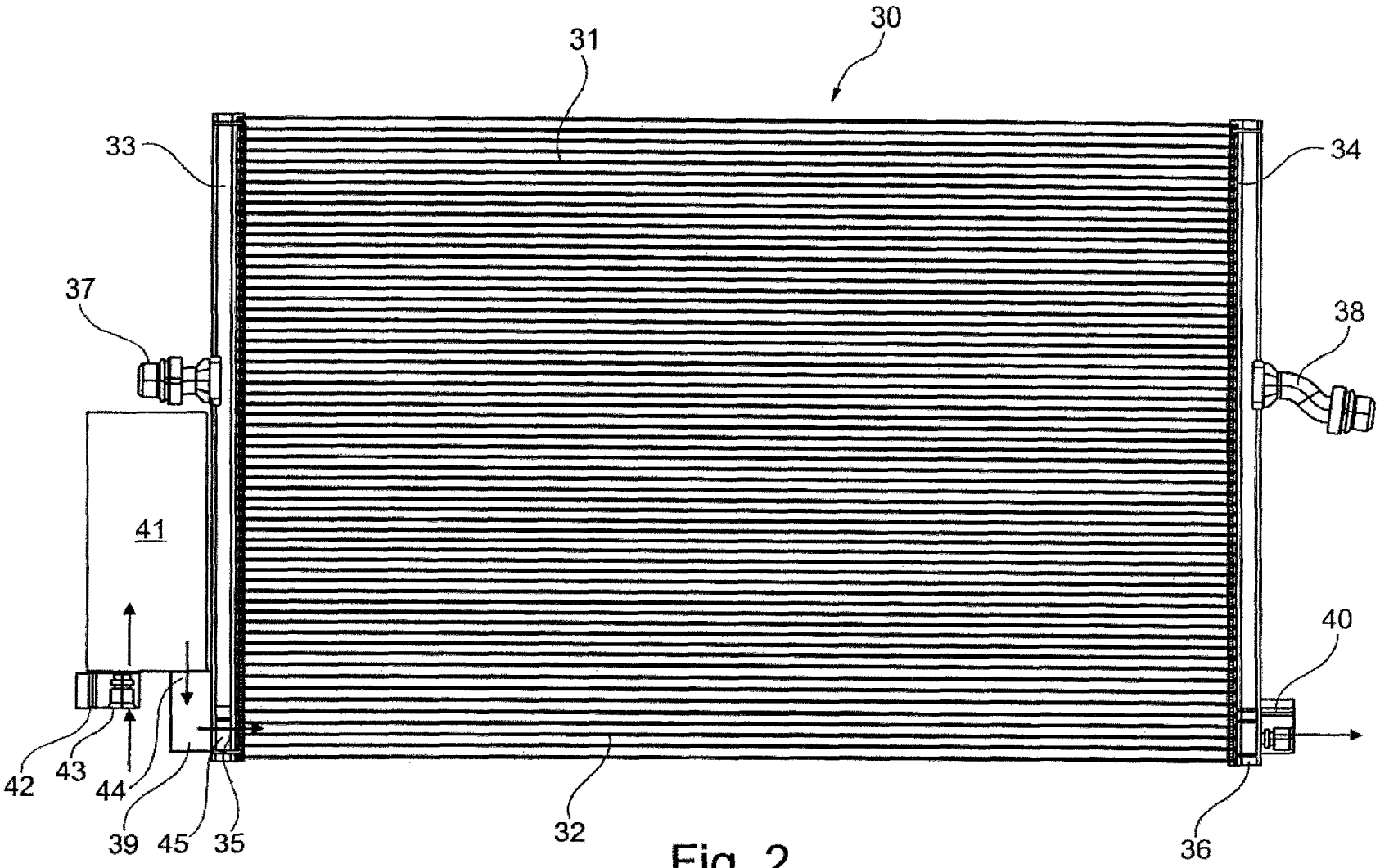
FIG. 2 illustrates an exemplary embodiment of a heat exchanger of the invention.

FIG. 2 shows a further exemplary embodiment of a heat exchanger 30 of the invention with a first tube/fin block 31 and a second tube/fin block 32, whereby a header 33, 34 and 35, 36 is arranged on both sides of tube/fin blocks 31, 32. Fluid connections 37 and 38, as well as 39 and 40, are associated with headers 33, 34 and 35, 36. In this case, as already described in regard to the exemplary embodiment in FIG. 1, one fluid connection each is associated with a header, as is also shown in FIG. 2. Alternatively, two fluid connections can also be associated with one of these two headers, whereby then preferably no fluid connection must be associated with the opposite header. In case that nevertheless a fluid should be branched off the opposite header, a $3^{rd}$ fluid connection could be provided there as well. This could be used both for the low-temperature coolant cooler and for the refrigerant cooler, depending on the requirements in the employed vehicle or in the employed coolant or refrigerant circuit.

The exemplary embodiment of FIG. 2 shows, apart from heat exchanger 30, also a refrigerant collector 41, which can be supplied with a fluid, preferably with a refrigerant, via a fluid connection 42. The fluid flows through inlet opening 43 to fluid connection 42 into collector 41. There, the fluid can be preferably collected and streamed through a fluid outlet 44 into inlet 45 of the heat exchanger. Fluid inlet 45 for the heat exchanger forms the fluid connection for the refrigerant cooler or refrigerant subcooler, so that a fluid, preferably a refrigerant, can flow through fluid connection 42 into the collector, from there out of the collector again through fluid connection 39 into inlet opening 45 in order to flow through tube/fin block 32 of the heat exchanger, before it flows into header 36 and again flows out of the heat exchanger out of fluid connection 40.

Preferably not only a collecting function can be realized in collector 41, but also a drying and/or filter function. To this end, a filter through which fluid is preferably forced between the inflow opening and the outflow opening, can be provided in the collector. Furthermore, the dryer function can be realized by the arrangement of drying agents. In this case, however, it is not absolutely necessary that the drying agent is in the direct flow between the inflow and outflow opening. Because the drying agent exerts its effect based on a partial pressure gradient, it is not necessary that there is flow directly around it but it can be totally sufficient that it is arranged in a stored liquid volume.

Figure 3:
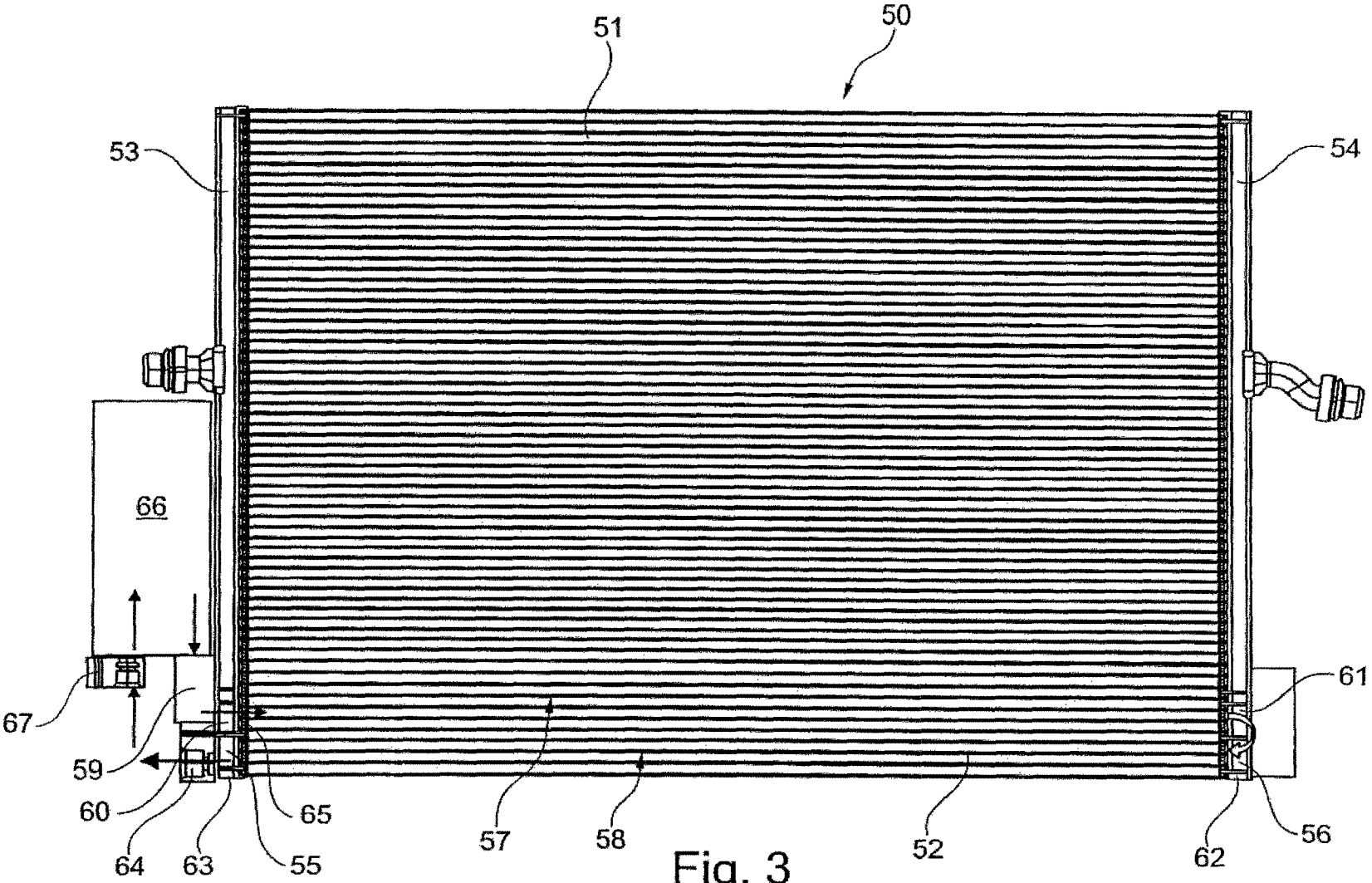
FIG. 3 illustrates an exemplary embodiment of a heat exchanger of the invention.

FIG. 3 shows a further exemplary embodiment of the heat exchanger of the invention, whereby again wheat exchanger 50 is evident with a first tube/fin block 51 and a second tube/fin block 52, whereby again headers 53 and 54 are associated with tube/fin block 51 and headers 55 and 56 are associated with tube/fin block 52.

In this exemplary embodiment of FIG. 3, the flow through tube/fin block 52 is a dual flow; in other words, the tube/fin block is divided into two flows 57 and 58, whereby the tube/fin block is provided along the side with a fluid connection 59, through which a fluid flows into tube/fin block 57 and then through the corresponding header 60. From the header the fluid flows into tube/fin block 57, then again collected in header 61, redirected in region 62 of header 56, from where it is again fed into the tubes of tube/fin block 58 and combined in header 61 of header 55, before it is discharged out the heat exchanger at fluid connection 64.

The dual-flow design of tube/fin block 52 with flows 57 and 58 is attained in that header 55 is divided by a partition wall 65 into two regions 60, 63 and the fluid flows into the heat exchanger in region 60 and again flows out of the heat exchanger out of region 63. At the same time, header 56 serves regions 61 and 62, which, however, are not separated from one another by a partition wall, as a straighfforward redirection tube, which collects the fluid flowing in from tube/fin block 57 and admits it into tube/fin block 58.

Furthermore, a collector 66 can be seen in FIG. 3, which is provided with a fluid connection 67, so that a fluid can flow into the collector through the inflow opening of fluid connection 67, and can be collected there before it flows via fluid connection 59 into tube/fin block 57 via header 65. Collector 66 can again be provided with a collecting function in accordance with the collector of FIG. 2, whereby a drying and/or a filter function can be realized in addition.

Figure 4:
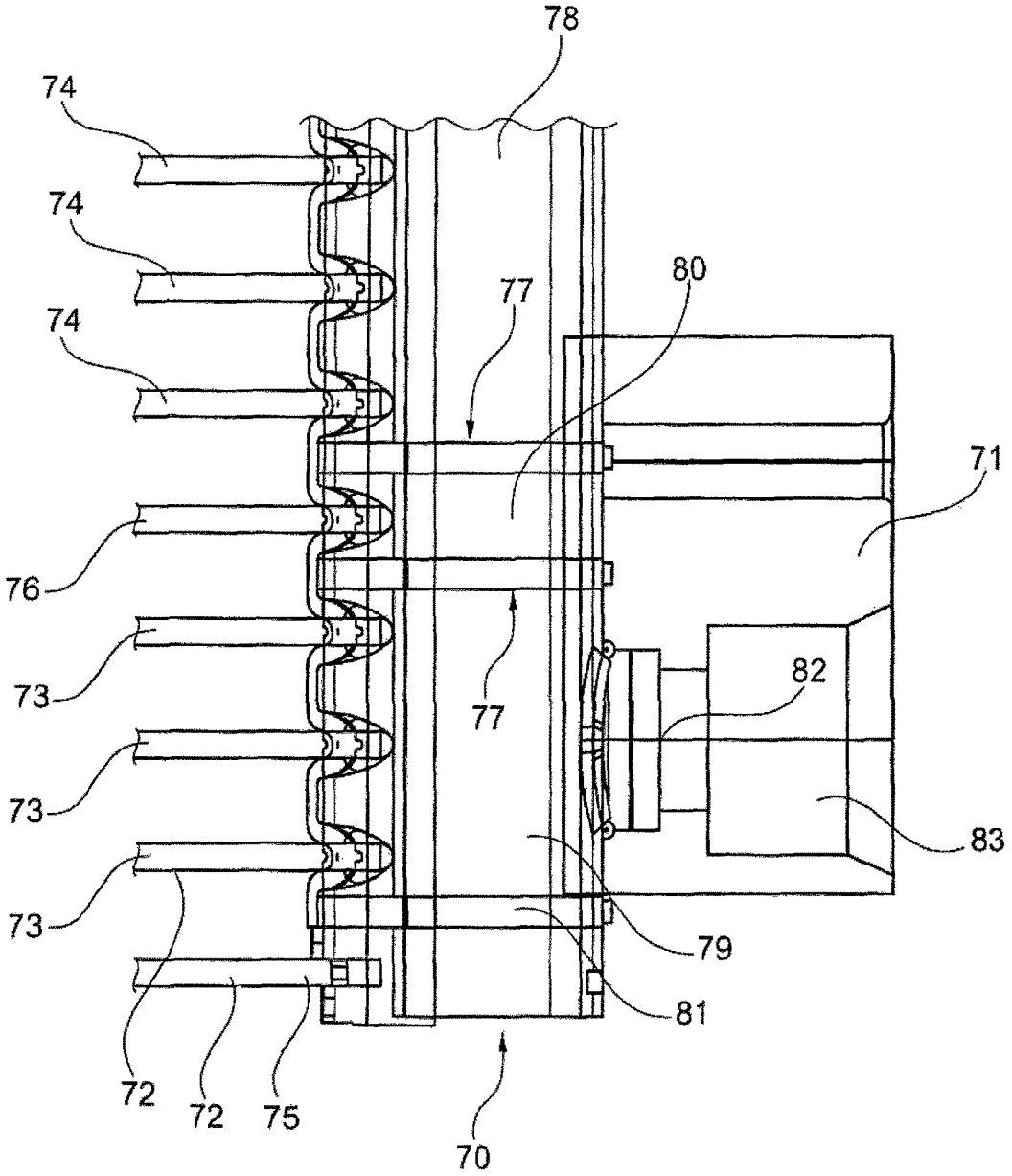
FIG. 4 is an illustration of a section of a heat exchanger of the invention with tubes of a tube/fin block and a header and a connecting flange.

FIG. 4 shows a view of an arrangement of a header 70 with a fluid connection 71 and tubes 72 of the tube/fin block.

Tubes 72 of the tube/fin block are divided into three different tube types. Tubes 73 are part of the second tube/fin block and tubes 74 are part of the first tube/fin block. Tube 75 serves as a side part and does not participate in the fluid transport between the headers. Tube 76 serves as a separation between the two tube/fin blocks and also does not participate in the fluid transport. This is evident by the two partition walls 77 separating top part 78 of the header from bottom part 79 of the header. Area 80 between the two partition walls 77 does not participate in the function as a header, but serves as spacing between the two headers for the different fluids and can function as leak detection area, should one of the two partition walls 77 start to leak, so that from an opening in the region of volume 80 the leaking fluid can leave there and be observed. Furthermore, partition wall 81 serves to terminate the header.

Fluid connection 82 to the header is realized by flange 71, which has a connecting opening 83, in which a connecting tube can be fitted.

Figure 5D:
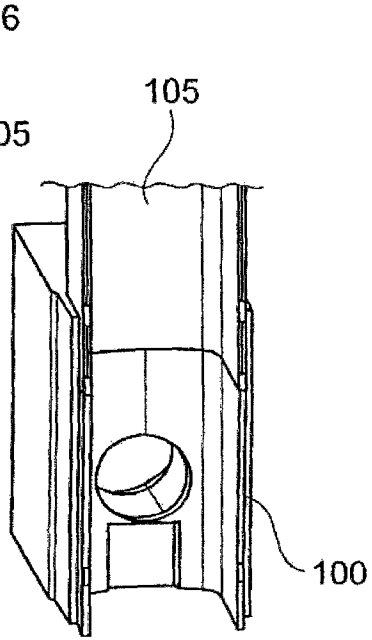
FIGS. 5*a* to FIG. 5*d* are each a view of parts for assembling a header of a heat exchanger of the invention and FIGS. 6*a* to FIG. 6*d* are each a view of parts for assembling a header of a heat exchanger of the invention.
Figure 5C:
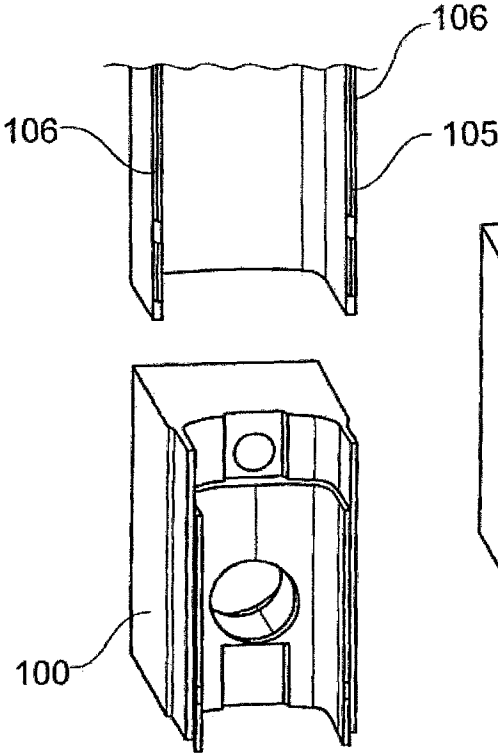
Figure 5B:
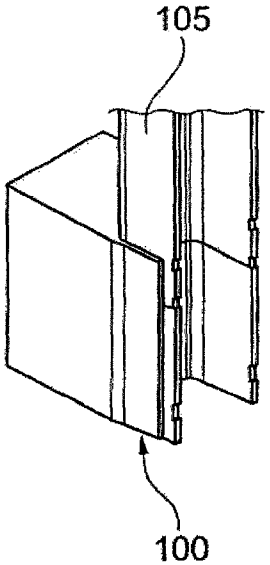
Figure 5A:
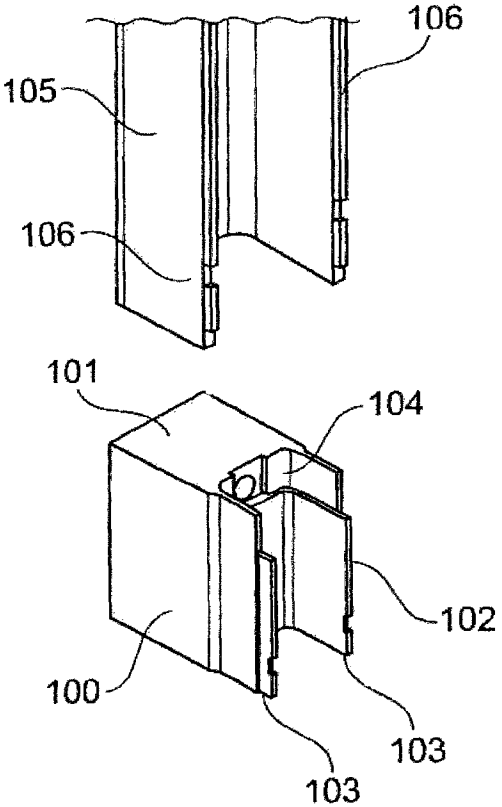

FIGS. 5*a* to 5*d* show options how a header with an integrated connecting flange as the fluid connection can be configured. FIG. 5*a* shows in the case of a flat tube having a flat tube bottom and a flat tube cover, whereby the flat tube bottom is the part with the tube openings and the flat tube cover is the part without the tube openings. Part 100 is an integrated flange 101 with a header cover 102, whereby said header cover is integrated such that side pieces 103 of the cover protrude from the flange and connection 104 between side walls 103 is formed by the body of flange 101. In the upper area, a cover 105 is used, which according to FIG. 5*b* is placed on the flange part, so that side walls 103 align with side walls 106 of the cover in the axial direction. FIGS. 5*c* and 5*d* show this once again in a different perspective, so that flange part 100 can be joined to cover 105 to form a solderable unit.

After the parts are assembled according to FIGS. 5*a* to 5*d*, FIGS. 6*a* to 6*d* show the insertion of the partition walls according to FIG. 4 in the header and the connection with the tube bottom and the fitting of the flat tubes into the tube openings in the tube bottom. It is evident in FIGS. 6*c* and 6*d* how a partition wall 110 can be inserted in flange part 100, whereby bottom partition wall 110, arranged at the end-side end of the flange, corresponds to partition wall 81 of FIG. 4. The two top partition walls, comparable to the two partition walls 77 of FIG. 4, function as a separation between the first and second tube/fin block.

Figure 6D:
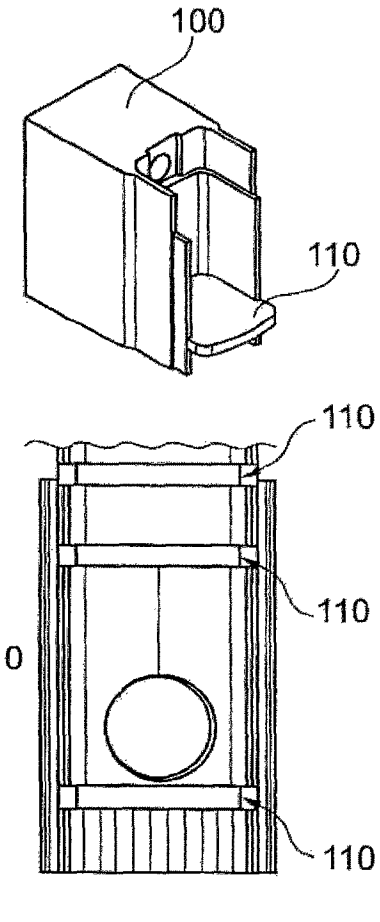
Figure 6C:
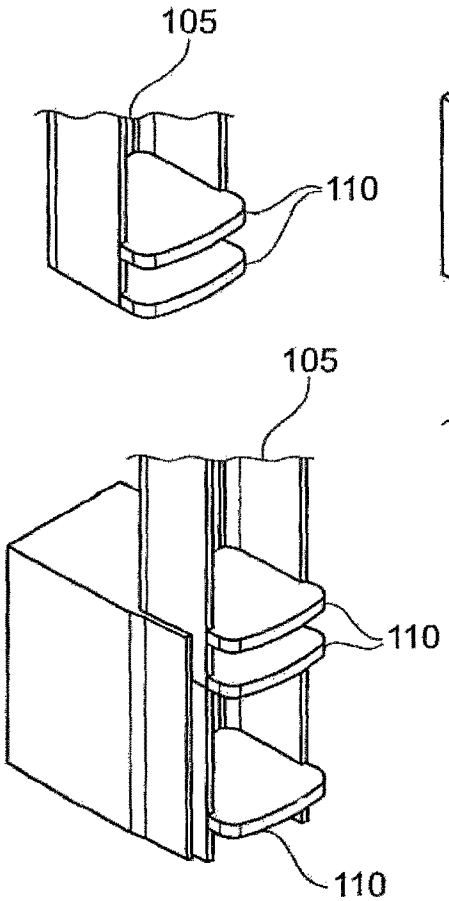
Figure 6B:
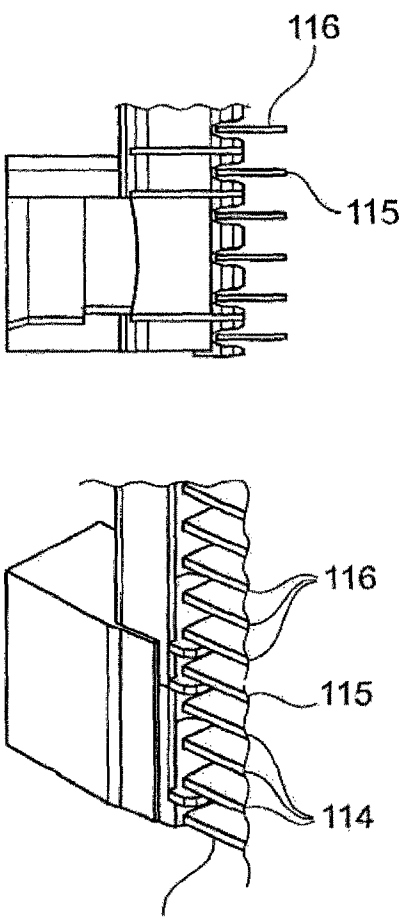
Figure 6A:
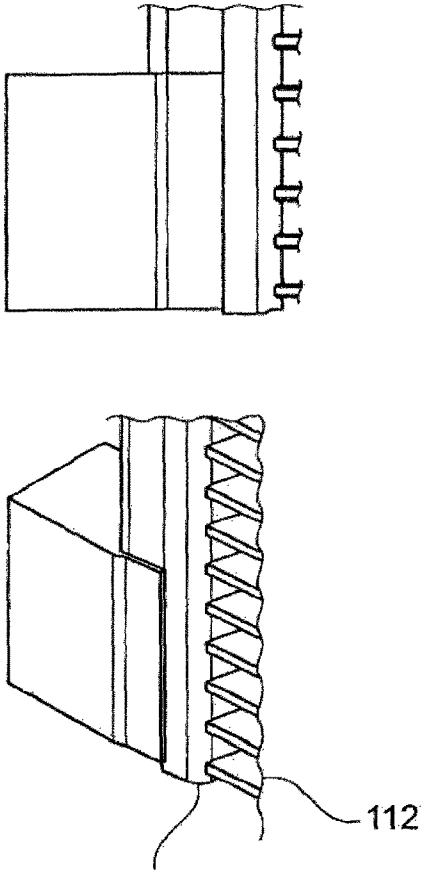

FIGS. 6*a* and 6*b* show, in a configuration according to FIGS. 6*c* and 6*d*, the top mounting of tube bottom 111 and the insertion of flat tubes 112. In this case, it is evident in FIG. 6*b* that the lowest flat tube 113 functions as a side part; the following flat tubes 114 function as the first tube/fin block, the next tube 115 causes a separation of the two tube/fin blocks, and the following tubes 116 form the first tube/fin block.

Figure 7:
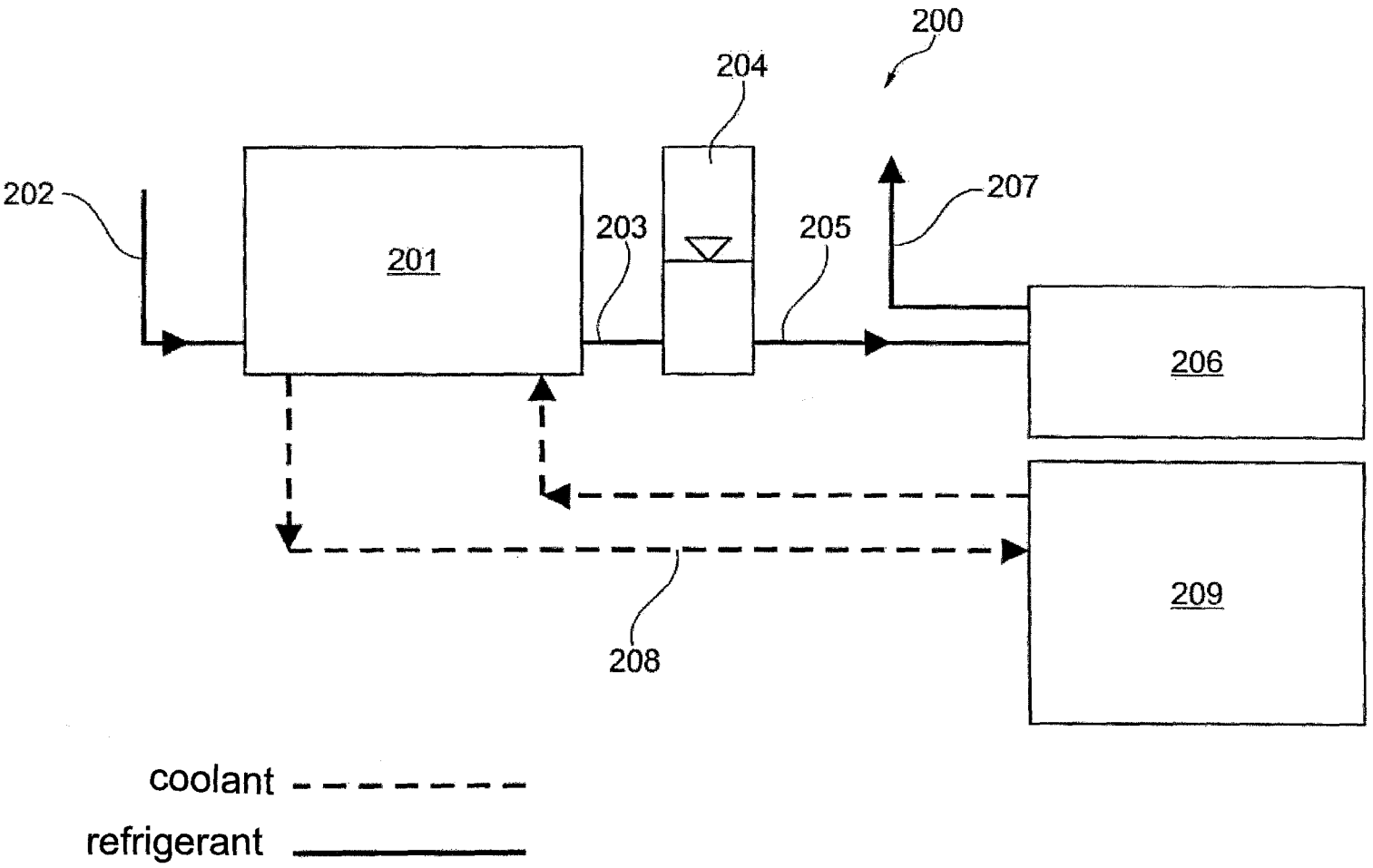
FIG. 7 is a schematic view of an arrangement of heat exchangers.

FIG. 7 shows schematically an arrangement of heat exchangers 200, in which a coolant-cooled condenser 201 from a line 202 of a compressor (not shown) receives a refrigerant, which is cooled and condensed in condenser 201, in which simultaneously a low-temperature coolant flowing through condenser 201 is heated. Next, the refrigerant flows through line 203 to collector 204, where it can be collected at least in part and optionally can be filtered and dried. Then the fluid flows through line 205 to subcooler 206, where it is cooled further. Subcooler 206 is preferably an air-cooled subcooler. Then the refrigerant flows through line 207 to the expansion valve and to the evaporator.

The low-temperature coolant for cooling the refrigerant in the condenser is circulated in a low-temperature circuit 208 and cooled in a low-temperature cooler 209, which is an air-cooled cooler. Subcooler 206 and low-temperature cooler 209 are two different parts in this exemplary embodiment.

Figure 8:
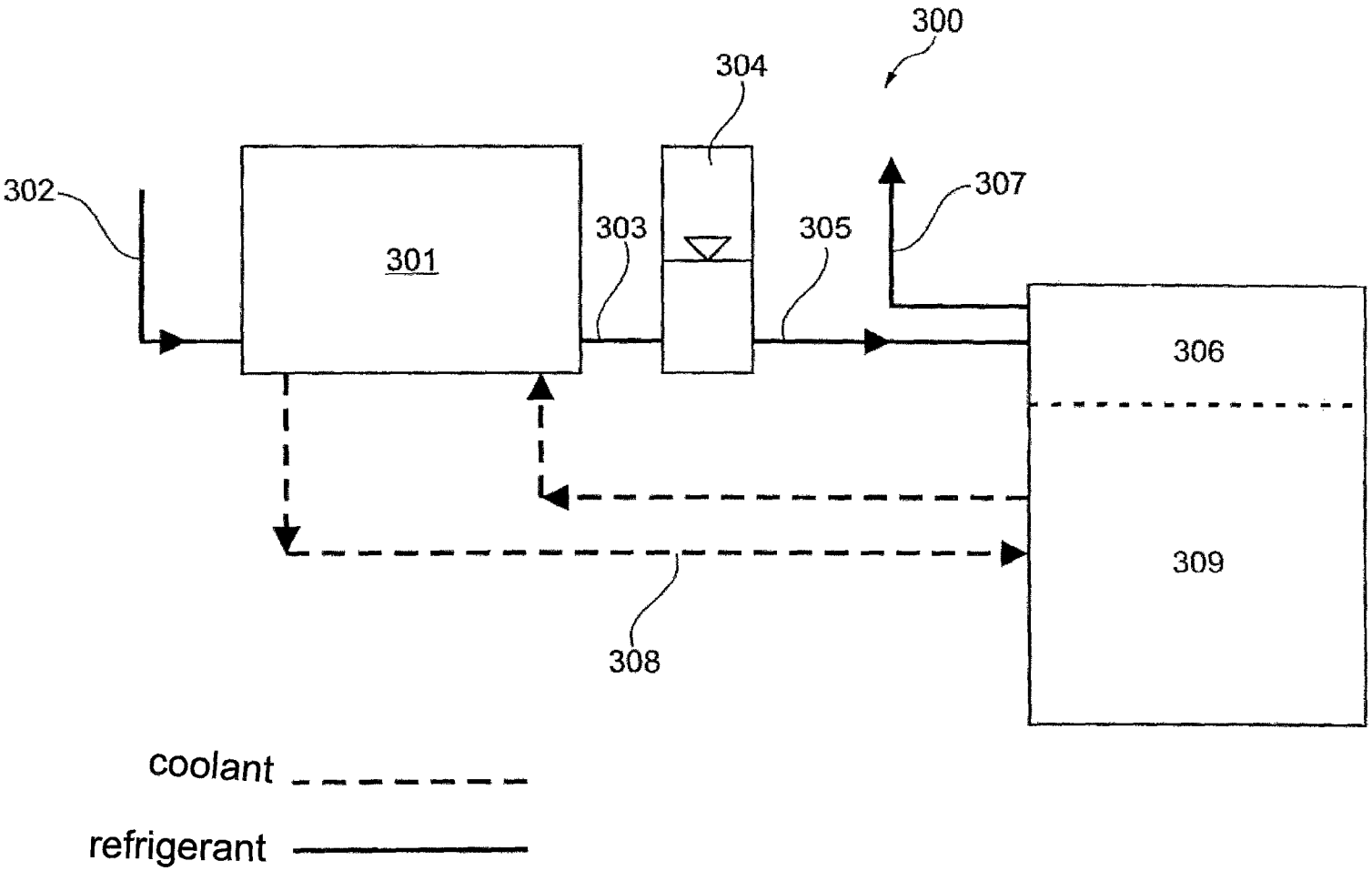
FIG. 8 is a schematic view of an arrangement of heat exchangers.

FIG. 8 shows schematically an arrangement of heat exchangers 300, in which a coolant-cooled condenser 301 from a line 302 of a compressor (not shown) receives a refrigerant that is deheated and condensed in condenser 301, in which simultaneously a low-temperature coolant flowing through condenser 301 is heated. Next, the refrigerant flows through line 303 to collector 304, where it can be collected at least in part and optionally can be filtered and dried. Next, the fluid flows through line 205 to subcooler 306, where it is cooled further. Subcooler 306 is preferably an air-cooled subcooler. Then the refrigerant flows through line 307 to the expansion valve and to the evaporator.

The low-temperature coolant for cooling the refrigerant in the condenser is circulated in a low-temperature circuit 308 and cooled in a low-temperature cooler 209, which is an air-cooled cooler. Subcooler 306 and low-temperature cooler 309 are configured as a structural unit in this exemplary embodiment.

It is especially advantageous, if the subcooler has no redirection, so that the refrigerant flows in an I-flow through the subcooler, and enters on one side, flows through the subcooler, and then leaves on the other side, as shown in FIG. 1 or 2. It is also especially advantageous, if the subcooler has at least one redirection, so that the refrigerant flows in a U-flow through the subcooler, thereby enters on one side, flows through the subcooler, is redirected to the other opposite side, again flows through the subcooler and leaves again on the side of the inlet, as shown in FIG. 3. It is also especially advantageous, if the subcooler has more than one redirection, such as, for example, at least two redirections, so that the refrigerant enters the subcooler on one side, flows through the subcooler, is redirected, again flows through the subcooler, is redirected, again flows through the subcooler, etc., and again leaves on one side.

Figure 9:
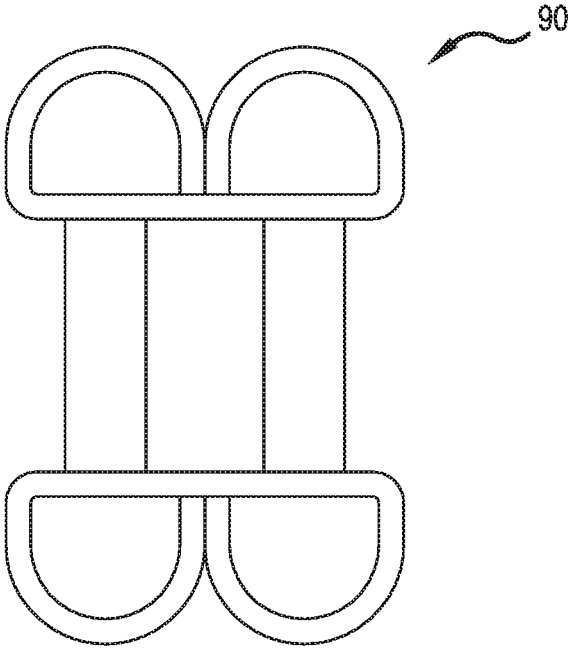
FIG. 9 illustrates an exemplary embodiment of a two-row tube.

Also, a header of the first tube/fin block and a header of the second tube/fin block can be configured as a two-row tube 90 (as shown in FIG. 9), whereby in each case a tube of the two-row tubes forms the respective header.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A heat exchanger comprising:

a first tube/fin block having a first side and a second side that opposes the first side;

the first tube/fin block having a first header arranged on the first side of the first tube/fin block and a second header arranged on the second side of the first tube/fin block, the first header and the second header of the first tube/fin block communicating with tubes of the first tube/fin block; and a second tube/fin block having a first side and a second side that opposes the first side;

the second tube/fin block having a first header arranged on the first side of the second tube/fin block and a second header arranged on the second side of the second tube/fin block, the first header and the second header of the second tube/fin block communicating with tubes of the second tube/fin block, wherein the first tube/fin block with the first header and the second header of the first tube/fin block is an air-side cooled coolant cooler, wherein the second tube/fin block with the first header and the second header of the second tube/fin block is an air-side cooled refrigerant cooler, wherein the first header of the first tube/fin block and the first header of the second tube/fin block are both provided on a first side of the heat exchanger and are connected to one another, and the second header of the first tube/fin block and the second header of the second tube/fin block are both provided on a second side of the heat exchanger and are connected to one another, and wherein the second tube/fin block has a single inlet for receiving refrigerant, the single inlet being provided on the first header of the second tube/fin block, the heat exchanger further including a collector that is fluidly connected to the second tube/fin block, wherein the collector includes a single fluid outlet, the single fluid outlet of the collector being fluidly connected by a fluid connection to the single inlet of the second tube/fin block, such that refrigerant flowing out of the fluid outlet of the collector enters the first header of the second tube/fin block through the single inlet, wherein the collector includes the single fluid outlet, the single fluid outlet of the collector being fluidly connected by the fluid connection to the single inlet of the second tube/fin block, such that the refrigerant flows through a single fluid inlet of the collector into the collector, flows out of the collector through the single fluid outlet of the collector, flows from the single fluid outlet of the collector into the fluid connection and flows from the fluid connection into the single inlet of the second tube/fin block, and wherein the fluid connection is a fluid conveying block, a first surface of the fluid conveying block directly contacting an outer surface of the collector and a second surface of the fluid conveying block directly contacting an outer surface of the first header of the second tube/fin block, the first surface of the fluid conveying block being oriented perpendicular to the second surface of the fluid conveying block.

2. The heat exchanger according to claim 1, wherein the first header of the first tube/fin block and the first header of the second tube/fin block are configured integrally with one another and the second header of the first tube/fin block and the second header of the second tube/fin block are configured integrally with one another.

3. The heat exchanger according to claim 1, wherein, on the first side of the heat exchanger, the first header of the first tube/fin block and the first header of the second tube/fin block are configured as a one-row tube, and on the second side of the heat exchanger, the second header of the first tube/fin block and the second header of the second tube/fin block are configured as a one-row tube.

4. The heat exchanger according to claim 1, wherein at least one of the first and second header of the first tube/fin block and at least one of the first and second header of the second tube/fin block are configured as a one-row tube.

5. The heat exchanger according to claim 1, wherein, on the first and second sides of the heat exchanger, a tube and/or the first and second headers of the first tube/fin block is/are the same as or different from a tube and/or the first and second headers of the second tube/fin block.

6. The heat exchanger according to claim 1, wherein the first and/or the second header of the first tube/fin block are provided with a first and/or a second fluid connection, and wherein the first and/or the second header of the second tube/fin block are provided with a third and/or fourth fluid connection.

7. The heat exchanger according to claim 1, wherein the collector is connected upstream of the second tube/fin block of the refrigerant cooler.

8. The heat exchanger according to claim 1, wherein the fluid connection is configured as a flange or a connecting tube.

9. An arrangement of heat exchangers comprising:

a coolant-cooled condenser for cooling and condensing a refrigerant in a refrigerant circuit of motor vehicles;

the heat exchanger according to claim 1, where the air-side cooled refrigerant cooler, in which the refrigerant, previously cooled and condensed in the condenser, is cooled further.

10. The arrangement according to claim 9, wherein the coolant-cooled condenser is cooled by a coolant from a coolant circuit.

11. The arrangement according to claim 9, wherein the air-side cooled refrigerant cooler is configured as a structural unit with the air-side cooled coolant cooler of a coolant circuit.

12. The arrangement according to claim 9, wherein the air-side cooled refrigerant cooler is configured separated from the air-side cooled coolant cooler of a coolant circuit, but is connected to the coolant circuit as a module.

13. A heat exchanger comprising:

a first tube/fin block having a first side and a second side that opposes the first side;

a first header arranged on the first side of the first tube/fin block and a second header arranged on the second side of the first tube/fin block, the first header and the second header of the first tube/fin block communicating with tubes of the first tube/fin block;

a second tube/fin block having a first side and a second side that opposes the first side;

a first header arranged on the first side of the second tube/fin block and a second header arranged on the second side of the second tube/fin block, the first header and the second header of the second tube/fin block communicating with tubes of the second tube/fin block; and a collector that is fluidly connected to the second tube/fin block, wherein the first tube/fin block with the first header and the second header of the first tube/fin block is an air-side cooled coolant cooler, wherein the second tube/fin block with the first header and the second header of the second tube/fin block is an air-side cooled refrigerant cooler, wherein the second tube/fin block has a single inlet for receiving refrigerant, the single inlet being provided on the first header of the second tube/fin block, wherein the collector includes a single fluid outlet, the single fluid outlet of the collector being fluidly connected by a fluid connection to the single inlet of the second tube/fin block, such that refrigerant flowing out of the fluid outlet of the collector enters the first header of the second tube/fin block through the single inlet, wherein the collector includes the single fluid outlet, the single fluid outlet of the collector being fluidly connected by the fluid connection to the single inlet of the second tube/fin block, such that the refrigerant flows through a single fluid inlet of the collector into the collector, flows out of the collector through the single fluid outlet of the collector, flows from the single fluid outlet of the collector into the fluid connection and flows from the fluid connection into the single inlet of the second tube/fin block, and wherein the fluid connection is a fluid conveying block, a first surface of the fluid conveying block directly contacting an outer surface of the collector and a second surface of the fluid conveying block directly contacting an outer surface of the first header of the second tube/fin block, the first surface of the fluid conveying block being oriented perpendicular to the second surface of the fluid conveying block.

* * * * *